US007559785B1

(12) United States Patent
Wu

(10) Patent No.: US 7,559,785 B1
(45) Date of Patent: Jul. 14, 2009

(54) PLUG CONNECTOR HAVING A LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,673

(22) Filed: Jun. 20, 2008

(51) Int. Cl.
*H01R 13/62* (2006.01)

(52) U.S. Cl. ..... 439/352

(58) Field of Classification Search ..... 439/352, 439/350, 351, 353–358
See application file for complete search history.

(56) References Cited

U.S. PATENT DOCUMENTS

| | | | | |
|---|---|---|---|---|
| 5,564,939 | A | 10/1996 | Maitani et al. | |
| 5,797,771 | A | 8/1998 | Garside | |
| 6,077,101 | A * | 6/2000 | Garretson et al. | 439/352 |
| 6,165,006 | A | 12/2000 | Yeh et al. | |
| 6,648,665 | B1 | 11/2003 | Wu | |
| 6,659,790 | B1 | 12/2003 | Wu | |
| 6,749,458 | B1 | 6/2004 | Kuo et al. | |
| 6,866,533 | B2 | 3/2005 | Wu | |
| 6,887,091 | B1 | 5/2005 | Wu | |
| 6,887,101 | B2 | 5/2005 | Ito et al. | |
| 7,445,484 | B2 * | 11/2008 | Wu | 439/352 |
| 7,473,124 | B1 * | 1/2009 | Briant et al. | 439/352 |
| 7,476,117 | B1 * | 1/2009 | Chen et al. | 439/352 |
| 2006/0189197 | A1 * | 8/2006 | Reed et al. | 439/352 |
| 2007/0161281 | A1 * | 7/2007 | Wu | 439/352 |
| 2008/0032541 | A1 * | 2/2008 | Reed et al. | 439/352 |

OTHER PUBLICATIONS

"SFF-8088 Specification for Compact Multilane Series: Shielded" published on Jun. 27, 2005 by SFF Committee.

* cited by examiner

*Primary Examiner*—Gary F. Paumen
(74) *Attorney, Agent, or Firm*—Wei Te Chung

(57) ABSTRACT

A plug connector (100) mating with a complementary connector includes a housing (1), a circuit board (7), a metal shell (5), and a latching mechanism (40) having a pusher (3) and a latch (2). The pusher has a head portion (34) provided with a resisting portion (340), a shaft (32) and a depressing portion (33). The latch has a nest (231) engageable with the resisting portion, and a latching portion (22) provided with a pair of claws (222). The metal shell has a resilient beam (52) resisting against the pressing portion of the pusher. The pusher is rotatable around the shaft to move the latch together with the claws between a latching position and an unlatching position.

17 Claims, 6 Drawing Sheets

PLUG CONNECTOR HAVING A LATCHING MECHANISM

BACKGROUND OF THE INVENTION

1. Field of the Invention

The present invention generally relates to a cable end connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products.

Specification SFF-8088 defines matable Compact Multilane Shielded connectors adopted for being used in laptop portable computer to connect small-size disk drives to a circuit board. The connectors comprise a plug connector connecting with the small-size drive and a header mounted on the circuit board. The plug connector defined in the specification comprises a pair of engagble metal housings together defining a receiving space therebetween, a circuit board received in the receiving space, a cable comprising a plurality of conductors electrically connecting with the circuit board, and a latching mechanism assembled to a top surface of the upper metal housing. The latching mechanism comprises an elongated T-shape latch member for latching with the header mentioned above and an actuating member cooperating with the latch member for actuating the latch member to separate from the header. The latch member is assembled to a rear portion of a base of the upper housing with latch portion exposed beyond a front portion of the base of the upper housing to locate above a tongue portion of the upper housing.

However, such elongated latch member is hard to be actuated by the actuating member, otherwise the latch member must have enough thickness or made by high-quality material having enough rigidity to achieve the goal of latching reliably and unlatching easily.

Hence, an improved plug connector is provided in the present invention to address the problems mentioned above and meet the current trend.

BRIEF SUMMARY OF THE INVENTION

Accordingly, an object of the present invention is to provide a plug connector having a latching mechanism for achieving a reliable latching and an easy unlatching.

In order to achieve the above-mentioned object, a plug connector mating with a complementary connector in accordance with the present invention comprises a housing, a latching mechanism having a pusher and a latch and assembled to the housing, and a metal shell attached to the housing. The pusher has a head portion provided with a resisting portion, a shaft and a depressing portion opposite to the resisting portion relative to the shaft. The latch has a nest engageable with the resisting portion, and a latching portion provided with a pair of claws. The metal shell has a resilient beam resisting against the pressing portion of the pusher. The pusher is rotatable around the shaft to move the latch together with the claws between a latching position and an unlatching position, due to an engagement between the resisting portion of the pusher and the nest of the latch.

The latching mechanism comprises a pusher and a latch cooperated with each other to latch or unlatch the complementary connector. When the pusher is operated, the latch would be driven from the latching position to the unlatching position automatically. When the pusher is released, the pusher would restore to the initial position automatically. It is easy to drive the whole latching mechanism to perform the latching and unlatching function, if only depressing the pusher or releasing the pusher. Additionally, the claws would latch the complementary connector reliably, since the latch restores itself to the latching position via a resilient restoring force provided by the resilient beams of the metal shell.

Other objects, advantages and novel features of the invention will become more apparent from the following detailed description of the present embodiment when taken in conjunction with the accompanying drawings.

DETAILED DESCRIPTION OF THE INVENTION

Figure 1:
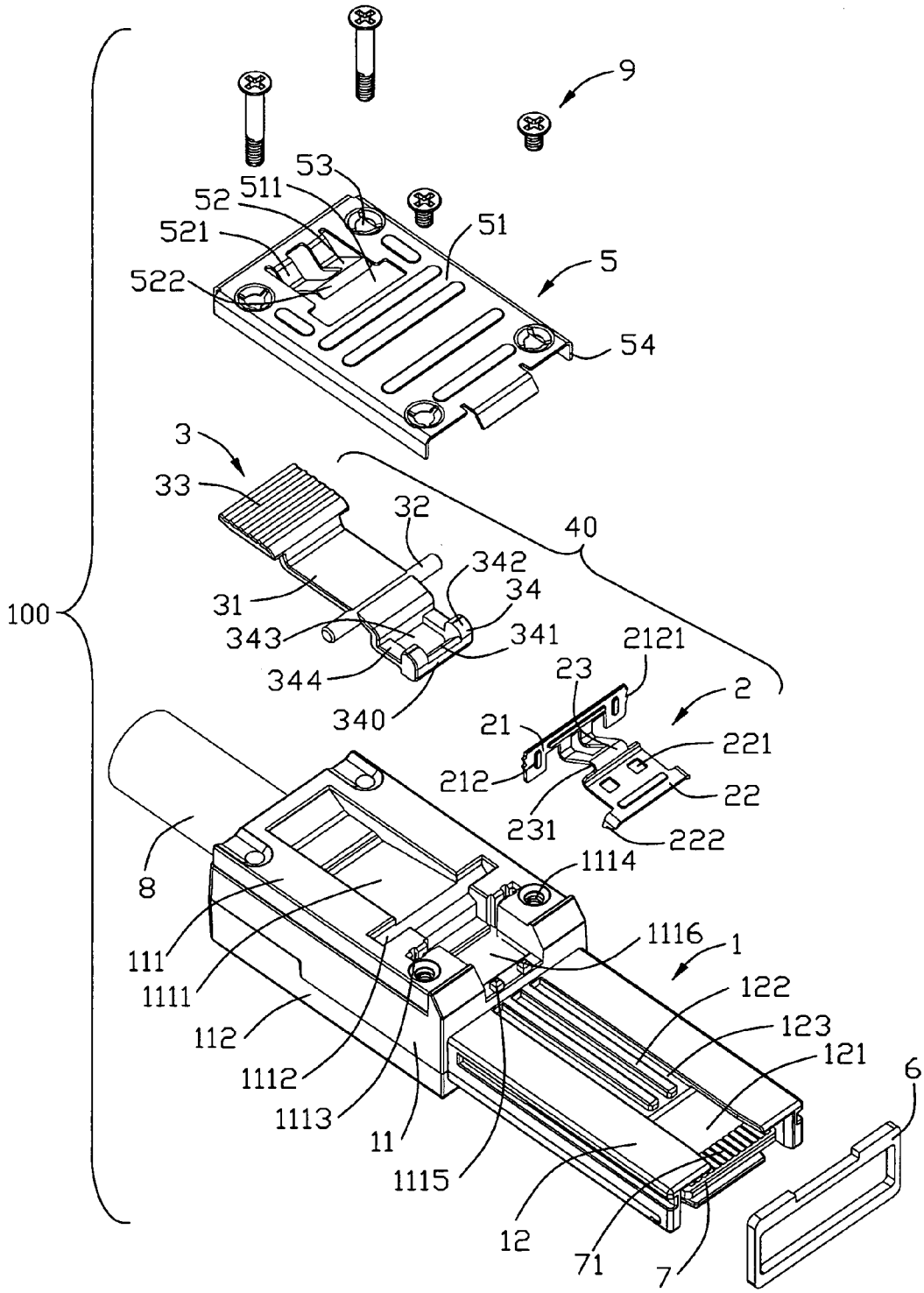
FIG. 1 is an exploded perspective view of a plug connector in accordance with the present invention.

Reference will now be made to the drawing figures to describe the present invention in detail.

Figure 2:
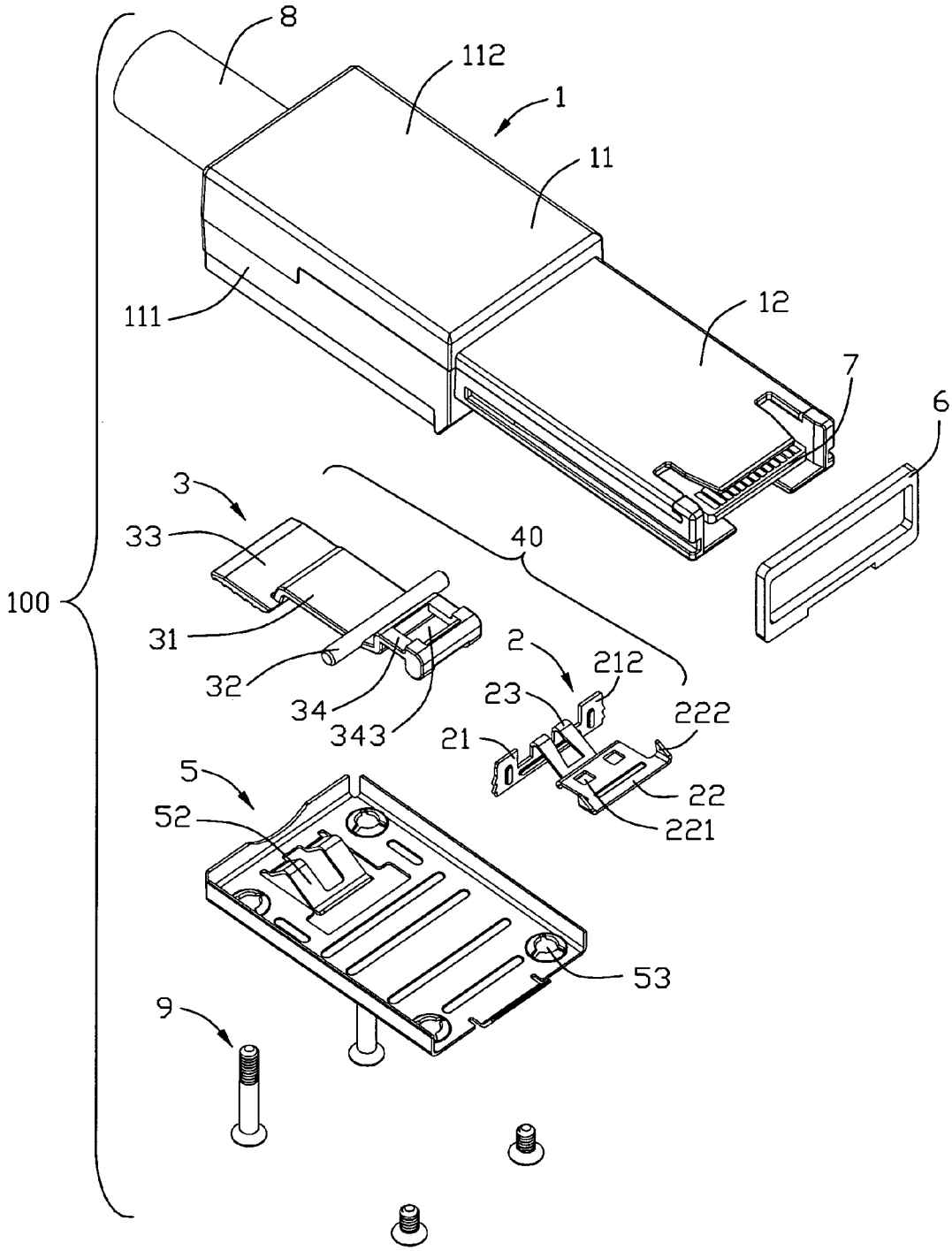
FIG. 2 is a view similar to FIG. 1, taken from another aspect.
Figure 3:
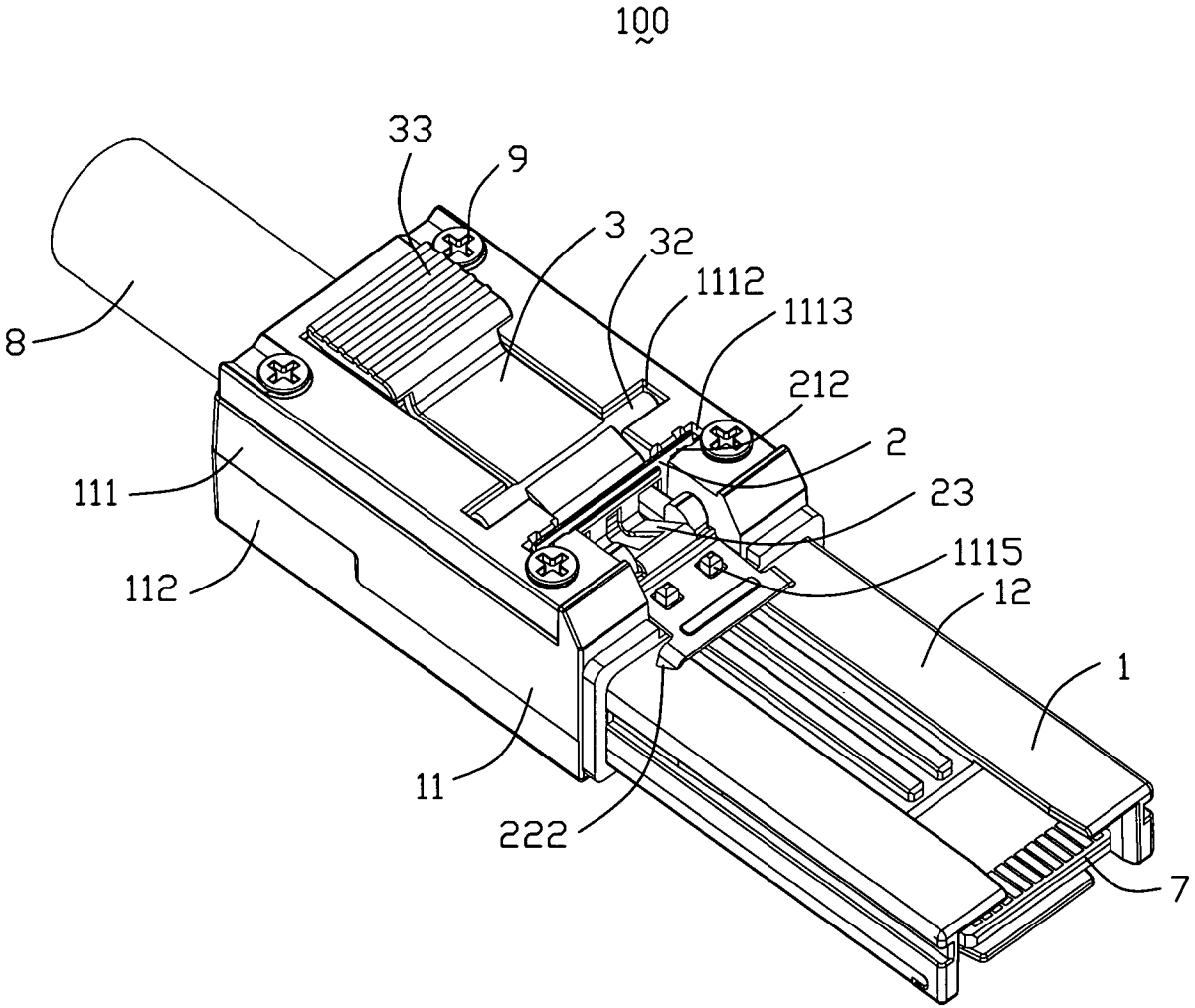
FIG. 3 is a partially assembled perspective view of the plug connector as shown in FIG. 1, with the metal shell being removed.

Referring to FIGS. 1-3, a plug connector 100 mating with a complimentary connector (not shown) in accordance with the present invention comprises a housing 1, a latching mechanism 40 assembled to the housing 1, an EMI gasket 6 attached to the housing 1, a metal shell 5 partially covering the latching mechanism 40, a plurality of screws 9 fixing the metal shell 5 on the housing 1, a circuit board 7 disposed in the housing 1, and a cable 8 electrically connected to the circuit board 7. Optionally, the cable 8 could be replaced by any other structure in accordance with customer's requires.

Referring to FIGS. 1-2, the housing 1 of the present invention comprises a base 11 and an elongated tongue portion 12 extending forwardly from the base 11. The base 11 comprises a lower base 112, an upper base 111 engaging with the lower base 112 and a receiving space (not shown) defined between the upper and lower bases 111, 112 for partially retaining the circuit board 7 and the cable 8 in a common manner. Both upper and lower bases 111 and 112 are preferably die-casted.

The upper base 111 defines an elongated receiving slot 1111, a retaining recess 1116 concave from an upper surface thereof. The receiving slot 1111 is father away from the tongue portion 12, than the retaining recess 1116 is away from the tongue portion 12. The upper base 111 comprises a transversely extending engaging recess 1112, an insertion recess 1113 communicating with the receiving slot 1111, four screw holes 1114 defined at four corners of the upper base 111, and a pair of protruding tabs 1115 formed at a front edge of the retaining recess 1116.

The circuit board 7 is formed with a plurality of conductive pads 71 for electrically connecting with the complementary connector. The tongue portion 12 has a receiving space defined therein for receiving a front portion of the circuit board 7, and an opening 121 defined on an upper surface thereof for exposing the conductive pads 71 of the circuit board 7. The tongue portion 12 has a plurality of flanges 122 formed on an upper surface thereof and a plurality of keyways 123 each defined adjacent to one flange 122.

The latching mechanism 40 comprises a latch 2 and a pusher 3 assembled to the latch 2. The latch 2 made of metal material is a cantilever-type member. The latch 2 comprises a transverse bar section 21 located in a vertical surface, a flat latching portion 22 located in a horizontal surface perpendicular to the vertical surface and an inclined connecting portion 23 connecting the bar section 21 and the latching portion 22 to provide resilient force to the latch 2. The bar section 21 has a pair of side sections 212 extending downwardly from opposite sides thereof. Each side section 212 is formed with a plurality of barbs 2121 on outmost edge thereof. The flat latching portion 22 defines a pair of rectangular holes 221 adjacent to the connecting portion 23, and a pair of claws 222 bending downwardly from opposite sides of the front edge thereof for clasping the complementary connector. The connecting portion 23 has a nest 231 disposed at a connection between the connection portion 23 and the latching portion 22. The connecting portion 23 also defines a hole therein for adjusting spring force of the latch 2 through changing size and shape of the hole.

The pusher 3 comprises a rectangular body portion 31, a shaft 32 formed at a substantially middle portion of the body portion 31, a rectangular pressing portion 33 formed at a free end of the body portion 31. and a head portion 34 opposite to the pressing portion 33 relative to the shaft 32. The head portion 34 comprises a pair of symmetrically formed flanges 344, a pair of blocks 342 respectively formed at a front portion of the flange 344, a resisting portion 340 between the pair of blocks 342, and an indentation 343 defined between the flanges 344. The resisting portion 340 has an inclined face 341 inclining toward the indentation 343.

The metal shell 5 comprises a top wall 51, a pair of side walls 54 bending downwardly from the top wall 51, a resilient beam 52 formed on the top wall 51. The top wall 51 has a window 511 defined in a rear portion thereof and four mounting holes 53 defined at four corner portions thereof. The resilient beam 52 has an L-shaped bending portion 521 disposed in the window 511. The bending portion 521 has a rear end connected to the top wall 51 and a front free end cantilevered in the window 511 to form itself as a deformable resisting section 522.

Referring to FIGS. 1-3, in assembly of the plug connector 100, the cable 8 is soldered to the circuit board 7. The circuit board 7 together with the cable 8 is partially sandwiched between the upper and lower bases 111, 112. The pusher 3 is mounted in receiving slot 1111, with the shaft 32 ratatably received in the engaging recess 1112 and the head portion 34 plunged in the retaining recess 1116. The latch 2 is inserted in the retaining recess 1116, with the connecting portion 23 plunged in the indentation 343 of the pusher 3. In conjunction with FIG. 5, the resisting portion 340 is plunged in the nest 231 of the connecting portion 23 to upwardly supporting the connecting portion 23 of the latch 2. The side sections 212 are inserted in the insertion recess 1113, with the barbs 2121 engaging with the insertion recess 1113. Thus, the latch 2 is restricted from a front-to-back movement. The pair of rectangular holes 221 engage with the pair of protruding tabs 1115.

Figure 4:
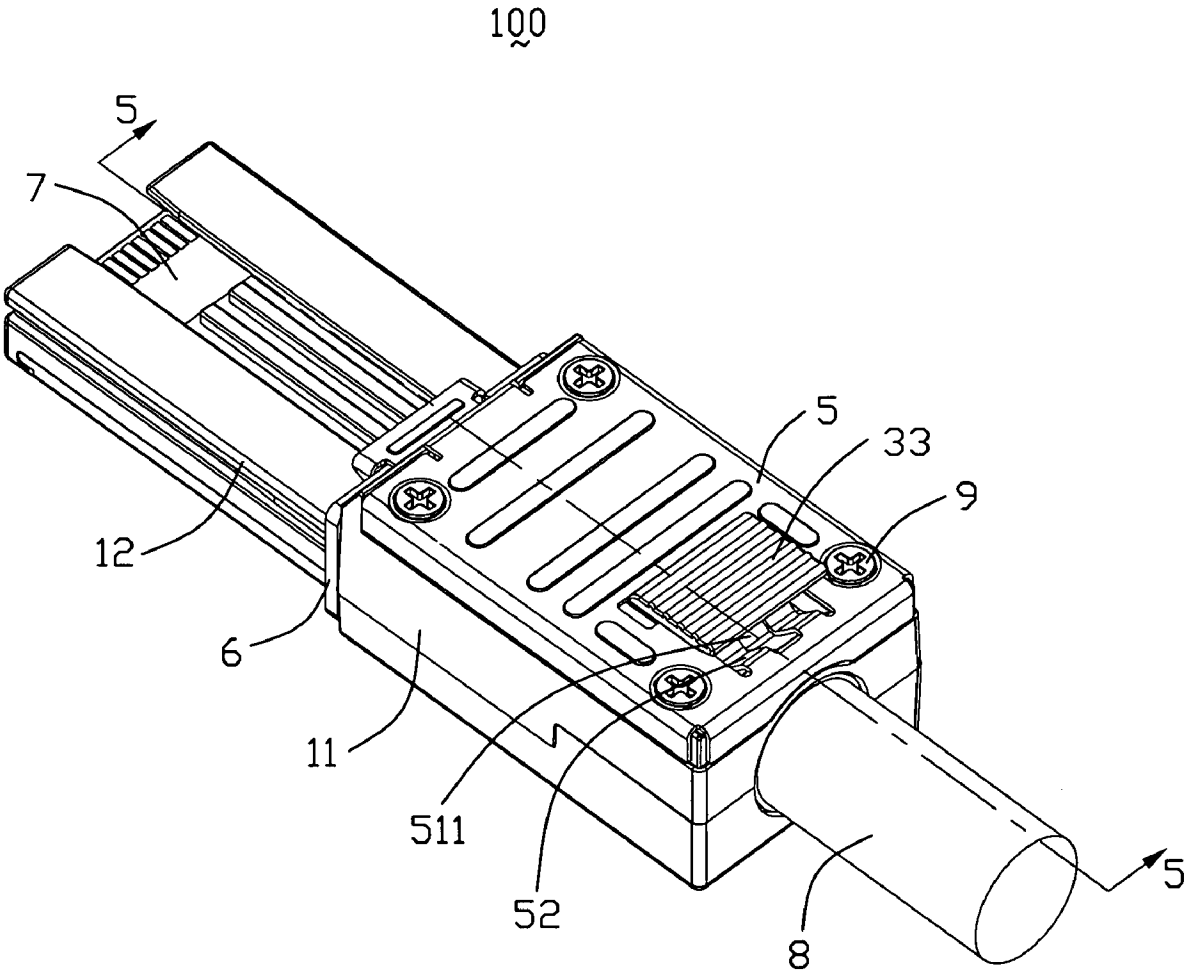
FIG. 4 is an assembled view of the plug connector as shown in FIG. 1.
Figure 5:
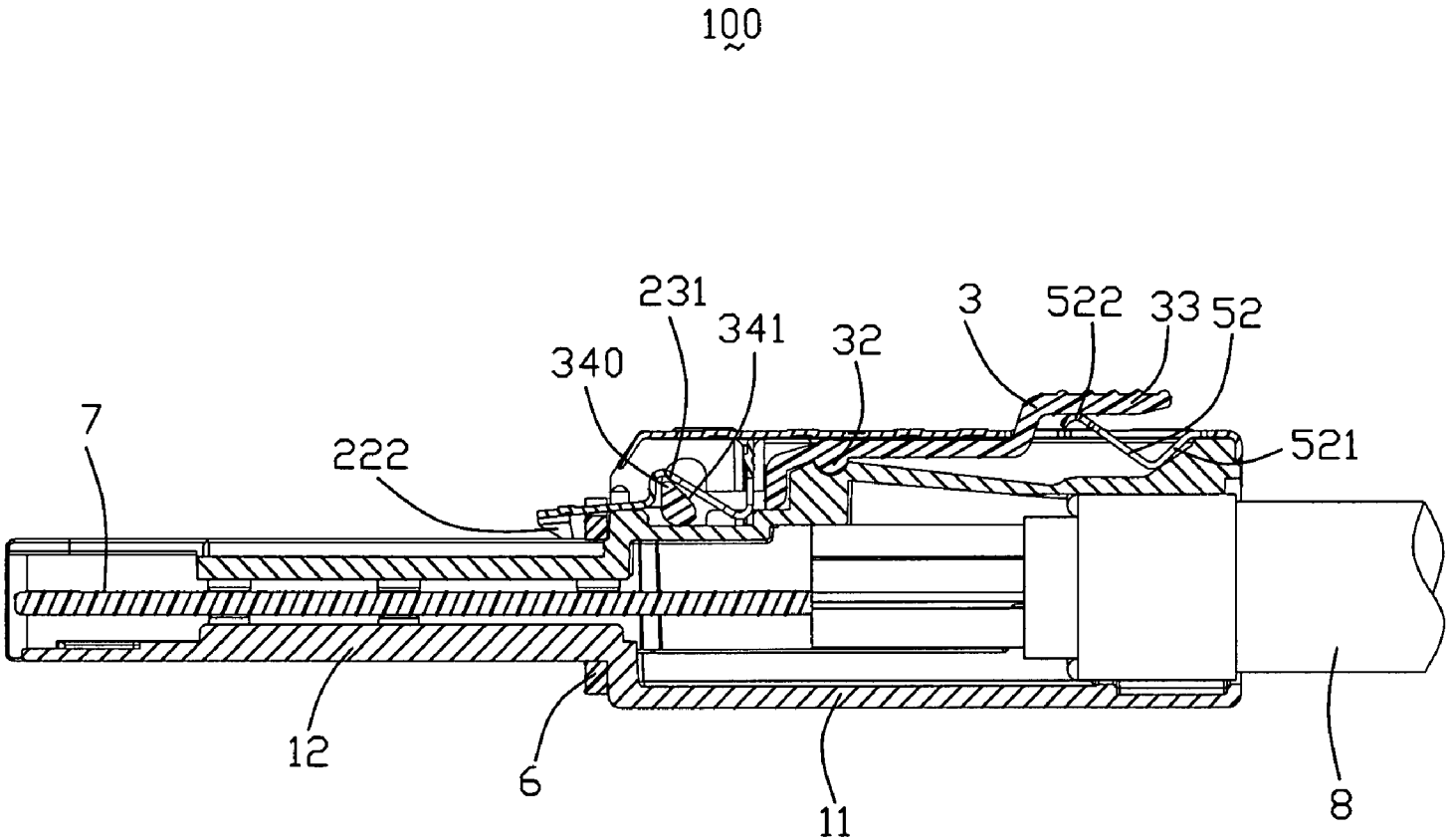
FIG. 5 is a cross-sectional view taken along line 5-5 of FIG. 4, when a latching mechanism is positioned in a latching position.

In conjunction with FIGS. 4 and 5, the EMI gasket 6 is attached to a front face of the base 11 of the housing 1 for shielding purpose. The metal shell 5 is fixed on the housing 1, with each screw 9 inserted through the mounting hole 53 into the screw hole 1114. The actuator 40 is partially covered by the metal shell 5, with the pressing portion 33 exposed outside the metal shell 5 through the window 511 and resisted against by the resisting section 522 of the resilient beam 52.

Figure 6:
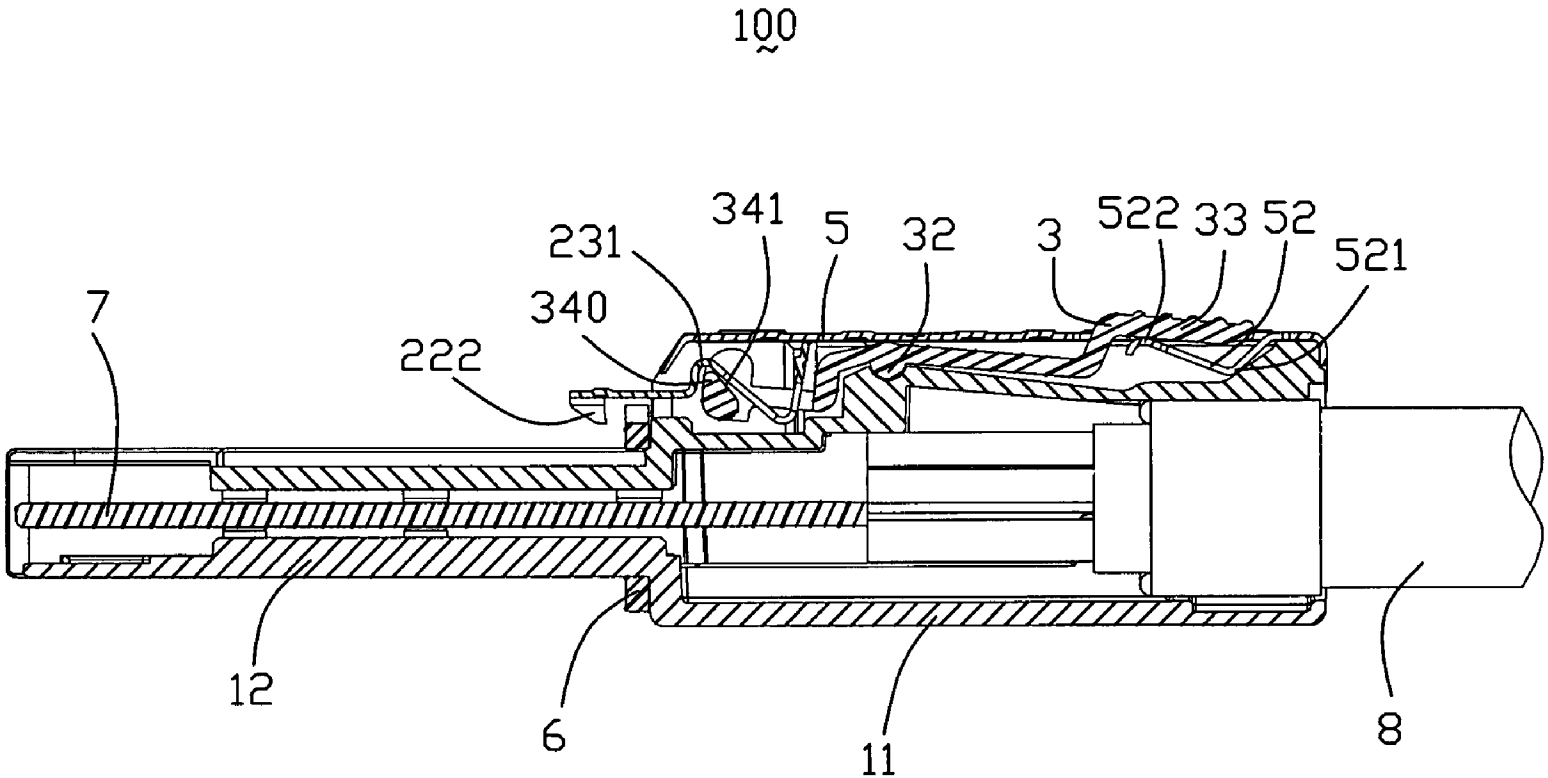
FIG. 6 is a cross-sectional view taken along line 5-5 of FIG. 4, when the latching mechanism is positioned in an unlatching position.

FIG. 5 illustrates the plug connector 100 located in a latching position and FIG. 6 illustrates the plug connector 100 located in an unlatching position. When the pressing portion 33 of the pusher 3 is depressed downwardly from an initial position to a final position, the resisting section 522 of the resilient beam 52 is actuated downwardly and the head portion 34 tilts upwardly around the shaft 32. The resisting portion 340 coupling with the connecting portion 23 moves upwardly to raise the connecting portion 23. The latching portion 22 together with the claws 222 move upwardly to a released position.

When the plug connector 100 is located in the unlatching position as shown in FIG. 6, the complementary connector could be mounted onto or removed from the plug connector 100. When the pressing portion 33 of the pusher 3 is released, the resilient beam 52 of the metal shell 5 would restore itself from the final position to the initial position. Simultaneously, the resilient beam 52 of the metal shell 5 would provide a resilient restoring force to raise the pressing portion 33 of the pusher 3. The pressing portion 33 together with the whole latching mechanism 40 revert to the latching position as shown in FIG. 5.

When the pressing portion 33 is released, the restoring force of the resilient beams 52 drives the pressing portion 33 to return to the initial position. The latch 2 thereby reverts to its original position. At this time, the complementary connector electrically connects with the conductive pads 71 of the circuit board 7, with claws 222 clasping corresponding structure of the complementary connector.

The latching mechanism 40 comprises a pusher 3 and a latch 2 cooperated with each other to latch or unlatch the complementary connector. When the pusher 3 is operated, the latch 2 would be driven from the latching position to the unlatching position automatically. When the pusher 3 is released, the pusher 3 would restore to the initial position automatically. It is easy to drive the whole latching mechanism 40 to perform the latching and unlatching function, if only depressing the pusher 3 or releasing the pusher 3. Additionally, the claws 222 would latch the complementary connector reliably, since the latch 2 restores itself to the latching position via the resilient restoring force provided by the resilient beams 52 of the metal shell 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector, comprising:

a housing comprising a base and a tongue portion extending forwardly from the base for fitting with the complementary connector;

a circuit board received in the housing;

a latching mechanism assembled to the base and comprising a pusher and a latch, said pusher having a head portion provided with a resisting portion, a shaft and a depressing portion opposite to the head portion relative to the shaft, said latch having a nest engageable with the resisting portion and a latching portion provided with a pair of claws; and a metal shell attached to the base, the metal shell having a window for outward passage of the pressing portion and a resilient beam disposed in the window and resisting against the pressing portion of the pusher;

wherein said pusher is pivotable about the shaft to engage the resisting portion with the nest of the latch to move the latch together with the claws from a latching position to an unlatching position.

2. The plug connector as claimed in claim 1, wherein said resilient beam of the metal shell is depressible by the pressing portion from an initial position toward a final position, to drive the resisting portion of the pusher raising the latch together with the claws from the latching position to the unlatching position.

3. The plug connector as claimed in claim 2, wherein said resilient beam of the metal shell is resiliently revertible from the final position to the initial position, to revert the latching mechanism from the unlatching position to the latching position.

4. The plug connector as claimed in claim 1, wherein said housing defines an elongated receiving slot defined at a rear portion of the base for retaining the pusher, and an enlongated retaining recess communicating with the receiving slot for retaining the latch.

5. The plug connector as claimed in claim 4, wherein said latch comprises a bar section and a pair of side sections formed at opposite sides of the bar section, said housing defining a transversely extending insertion recess communicating with the retaining recess for insertion of the side sections to restrict the latch from a front-to-back movement.

6. The plug connector as claimed in claim 5, wherein said latch comprise a connecting portion connecting the latching portion and the bar section, with said nest defined at a connection between the connecting portion and the latching portion, and the pair of claws symmetrically formed at opposite sides of the latching portion.

7. The plug connector as claimed in claim 6, wherein said latching portion of the latch defines a pair of holes, said housing is formed with a pair of protruding tabs at a front edge of the retaining recess for engaging with the pair of holes of the latch.

8. The plug connector as claimed in claim 6, wherein said resisting portion of the pusher has an inclined face, the connecting portion of the latch comprising a pair of L-shaped connecting beams each having an obliquely extending lower surface facing toward the inclined face of the resisting portion.

9. The plug connector as claimed in claim 8, wherein said head portion of the pusher defines an indentation for positioning the connection portion of the latch, said inclined face extending from the resisting portion toward the indentation.

10. The plug connector as claimed in claim 4, wherein said base defines a transversely extending engaging recess communicating with the receiving slot for rotatably retaining the shaft of the pusher.

11. The plug connector as claimed in claim 1, further comprising an EMI gasket attached to a front side of the base.

12. The plug connector as claimed in claim 1, further comprising a cable electrically connected with the circuit board, said base has an upper base and a lower base, said circuit board is sandwiched between the upper and lower bases.

13. The plug connector as claimed in claim 1, further comprising a plurality of screws, and wherein said base of the housing and the metal shell respectively define a plurality of mounting holes for insertion of the screws to fix the metal shell onto the housing.

14. An electrical connector comprising:

a housing defining a base;

a latch mechanism mounted upon the base, said latch mechanism including:

a pusher pivotally moveable relative to the housing and defining a rear pressing section and a front head portion; and a latch assembled to the base in a cantilevered manner at a rear fixed end and defining a claw at a front free end for latching to a complementary connector, under a condition that the head portion of the pusher engages the latch around the rear fixed end; wherein movement of the pressing section in a first lateral direction due to a force imposed in said first lateral direction, results in movement of the head portion in a second lateral direction opposite to the first lateral direction, and successively actuates the claw to move in said second lateral direction for disengagement from the complementary connector; wherein said latch is conductive metallic for retention consideration while said pusher is insulative plastic for operation consideration.

15. The electrical connector as claimed in claim 14, further including a metallic shell cooperating with the base to sandwich said latch and said pusher therebetween for protecting said latch and said pusher.

16. The electrical connector as claimed in claim 15, wherein said shell further provides resilient beam to urge said pusher to resume in an original position once the force is removed.

17. The electrical connector as claimed in claim 15, wherein the pressing section is essentially located with a contour of said shell.

* * * * *